US012396581B2

(12) United States Patent
Mitchell

(10) Patent No.: US 12,396,581 B2
(45) Date of Patent: Aug. 26, 2025

(54) TACO HOLDER

(71) Applicant: JOBMOMMA LLC, Yonkers, NY (US)

(72) Inventor: Tonia Mitchell, Yonkers, NY (US)

(73) Assignee: JOBMOMMA LLC, Yonkers, NY (US)

( * ) Notice: Subject to any disclaimer, the term of this patent is extended or adjusted under 35 U.S.C. 154(b) by 733 days.

(21) Appl. No.: 17/840,171

(22) Filed: Jun. 14, 2022

(65) Prior Publication Data

US 2022/0400881 A1 Dec. 22, 2022

Related U.S. Application Data

(60) Provisional application No. 63/212,282, filed on Jun. 18, 2021.

(51) Int. Cl.

| | |
|---|---|
| ***A47G 21/00*** | (2006.01) |
| ***A47F 1/12*** | (2006.01) |
| ***A47F 7/00*** | (2006.01) |
| *A47B 75/00* | (2006.01) |
| *A47G 19/30* | (2006.01) |

(52) U.S. Cl.

CPC ..... *A47G 21/001* (2013.01); *A47F 1/125* (2013.01); *A47F 7/00* (2013.01); *A47B 75/00* (2013.01); *A47F 7/0071* (2013.01); *A47G 2019/306* (2013.01)

(58) Field of Classification Search

CPC ..... A47G 21/001; A47G 2019/306; A47G 1/125; A47G 2400/10; A47G 19/30; A47G 19/32; A47G 2200/106; A47G 2023/0666; A47G 23/0625; A47G 19/06; A47F 1/126; A47F 1/125; A47F 7/0071; A47F 7/00; A47B 75/00; B65D 85/36; B65D 65/16; B65D 77/2024; B65D 2577/205

See application file for complete search history.

(56) References Cited

U.S. PATENT DOCUMENTS

| | | | | | |
|---|---|---|---|---|---|
| 3,446,416 | A | * | 5/1969 | Epstein | A47G 21/001 229/87.08 |
| 4,270,660 | A | * | 6/1981 | Putt | A47G 19/30 211/85.4 |
| D263,786 | S | * | 4/1982 | Kohan | D19/90 |
| 4,362,247 | A | * | 12/1982 | Rueda | A47G 19/30 211/85.4 |
| D278,199 | S | * | 4/1985 | Richards | D7/411 |

(Continued)

*Primary Examiner* — Devin K Barnett

(74) *Attorney, Agent, or Firm* — Leason Ellis LLP

(57) ABSTRACT

A taco holder includes a rigid body and a pusher. The body is shaped like a truncated taco shell, including two sides and a bottom corresponding to those of the taco shell. An inside of the body cradles the taco in a lengthwise direction. The body sides include respective sliding slots penetrating the body and arranged in the lengthwise direction. The pusher is shaped like an angled cross-section of the body and contacts respective edges of the sides of the cradled taco. The pusher includes respective tabs extending through the sliding slots for securing the pusher to the inside of the body while allowing movement of the pusher and contacted taco along the inside of the body in the lengthwise direction. The pusher pushes the taco toward the truncated end in response to applied pressure to the tabs from outside the body in the lengthwise direction.

18 Claims, 10 Drawing Sheets

(56) References Cited

U.S. PATENT DOCUMENTS

D279,160 S * 6/1985 Hunt ..... D7/411
D282,338 S * 1/1986 Putt ..... D7/504
4,573,570 A * 3/1986 Cortopassi ..... A47G 19/30 426/396
4,653,645 A * 3/1987 Thomas ..... A47G 19/30 426/119
D304,664 S * 11/1989 Wyant ..... D7/504
4,938,515 A * 7/1990 Fazio ..... A41D 13/082 2/21
D318,984 S * 8/1991 Wickham ..... D7/601
D319,372 S * 8/1991 Cobb ..... D7/504
D334,111 S * 3/1993 Yockey ..... D7/507
D350,671 S * 9/1994 Asner ..... D7/504
6,273,278 B1 * 8/2001 Enyedy ..... A47F 7/0071 211/85.4
D467,121 S * 12/2002 Zietz ..... D7/504
D523,289 S * 6/2006 David ..... D7/601
D524,112 S * 7/2006 Cogley ..... D7/601
D524,114 S * 7/2006 Dodge ..... D7/601
D538,596 S * 3/2007 Camp ..... D7/504
D563,166 S * 3/2008 Woolfolk ..... D7/553.6
D668,507 S * 10/2012 Williamson ..... D7/504
D728,894 S * 5/2015 Rogers ..... D1/122
D735,966 S * 8/2015 Boldt ..... D1/122
D770,243 S * 11/2016 Esquivel ..... D7/672
D857,522 S * 8/2019 Blake ..... D9/710
D892,553 S * 8/2020 Summers ..... D7/586
D966,815 S * 10/2022 Spruell ..... D7/504
D1,021,536 S * 4/2024 Turner ..... D7/553.1
D1,025,705 S * 5/2024 Gilmore ..... D7/504
D1,030,412 S * 6/2024 Gilmore ..... D7/504
D1,043,245 S * 9/2024 He ..... D7/504
D1,045,505 S * 10/2024 Godsill ..... D7/368
2008/0193613 A1 * 8/2008 Kovich ..... A21D 13/42 426/138
2016/0316947 A1 * 11/2016 Shendelman ..... A47G 21/001
2018/0213958 A1 * 8/2018 Shendelman ..... A47G 23/0625

* cited by examiner

200

200

TACO HOLDER

CROSS-REFERENCE TO RELATED APPLICATION

This application claims the benefit of U.S. Provisional Application No. 63/212,282, filed Jun. 18, 2021, which is incorporated by reference herein in its entirety.

FIELD OF THE DISCLOSURE

The present disclosure relates in general to a utensil and in particular to a taco holder that holds a hard-sided taco and facilitates eating the taco without breaking the shell or making a mess.

BACKGROUND OF THE DISCLOSURE

Hard-sided tacos are popular food items. However, they can be messy to consume as the taco shell is subject to breaking earlier than desired and the filling is subject to coming out of the taco shell before consumption.

It is in regard to these and other problems in the art that the present disclosure is directed to provide a technical solution for an effective taco holder that reduces shell breakage and mess of a taco during consumption.

SUMMARY OF THE DISCLOSURE

According to a first aspect of the disclosure, a taco holder for holding a hard-sided taco while eating is provided. The taco holder comprises a rigid body and a pusher. The rigid body has a truncated shape of similar proportions to a taco shell of the hard-sided taco, including two sides and a bottom connecting the two sides and corresponding to sides and bottom of the taco shell, an inside of the body being larger than and configured to cradle the hard-sided taco in a lengthwise direction along a length of the taco, the sides of the body including respective sliding slots penetrating the body and arranged in the lengthwise direction. The pusher has a shape of an angled cross-section of the body and configured to contact respective edges of the sides of the taco shell of the cradled taco, the pusher comprising respective tabs extending through the sliding slots for securing the pusher to the inside of the body while allowing movement of the pusher and contacted taco along the inside of the body in the lengthwise direction. The pusher is configured to push the contacted taco from one end of the body to a truncated end of the body in response to pressure applied to at least one of the tabs from an outside of the body in the lengthwise direction, In an embodiment consistent with the above, the truncated end of the body comprises a rest to elevate the truncated end of the body with respect to the one end of the body when resting on a flat level surface, the rest being further configured to contact the surface in conjunction with the one end of the body and allow the body and cradled taco to stand up on the surface.

In an embodiment consistent with the above, the rest is further configured to make at least two points of contact with the surface when the body is standing up.

In an embodiment consistent with the above, the bottom of the body is flat.

In an embodiment consistent with the above, the taco shell has a shape of a symmetrically folded circle, the fold being centered at the bottom of the taco shell and extending in the lengthwise direction when the hard-sided taco is cradled in the taco holder.

In an embodiment consistent with the above, the sliding slots oppose each other in a widthwise direction perpendicular to the lengthwise direction, the pusher has a height in a height direction perpendicular to the lengthwise and widthwise directions, and the cross-section of the body in the lengthwise direction between the sliding slots is uniform below the height of the pusher.

In an embodiment consistent with the above, the pusher is inwardly curved to conform to the edges of the sides of the taco shell of the cradled taco.

In an embodiment consistent with the above, each side of the body extends away from the bottom of the body at an oblique angle to define the angled cross-section of the body and wherein the shape of the pusher conforms to the so-defined oblique angles to define the angled cross-section of the body.

In an embodiment consistent with the above, edges of the pusher adjacent to each side of the rigid body move in response to the applied pressure with a uniform, close spacing to each side, whereby the edges of the sides of the taco shell of the contacted taco are engaged by the pusher throughout its movement in the lengthwise direction.

According to another aspect of the disclosure, a taco holder for holding a hard-sided taco while eating is provided. The taco holder comprises a rigid body and a pusher. The rigid body has a truncated shape of similar proportions to a taco shell of the hard-sided taco, including two sides and a bottom connecting the two sides and corresponding to sides and bottom of the taco shell, an inside of the body being larger than and configured to cradle the hard-sided taco in a lengthwise direction along a length of the taco, the sides and bottom of the body including respective sliding slots arranged in the lengthwise direction. The pusher has a shape of an angled cross-section of the body and configured to contact respective edges of the sides of the taco shell of the cradled taco, the pusher comprising respective tabs extending through the sliding slots for securing the pusher to the inside of the body while allowing movement of the pusher and contacted taco along the inside of the body in the lengthwise direction. The pusher is configured to push the contacted taco from one end of the body to a truncated end of the body in response to pressure applied to at least one of the tabs from an outside of the body in the lengthwise direction, In an embodiment consistent with the second taco holder described above, the truncated end of the body comprises a rest to elevate the truncated end of the body with respect to the one end of the body when resting on a flat level surface, the rest being further configured to contact the surface in conjunction with the one end of the body and allow the body and cradled taco to stand up on the surface while not allowing the respective tab extending through the respective sliding slot of the bottom of the body to contact the surface.

In an embodiment consistent with the second taco holder described above, the rest is further configured to make at least two points of contact with the surface when the body is standing up on the surface.

In an embodiment consistent with the second taco holder described above, the bottom of the body is flat.

In an embodiment consistent with the second taco holder described above, the taco shell has a shape of a symmetrically folded circle, the fold being centered at the bottom of the taco shell and extending in the lengthwise direction when the hard-sided taco is cradled in the taco holder.

In an embodiment consistent with the second taco holder described above, the respective sliding slots of the sides of the body oppose each other in a widthwise direction perpendicular to the lengthwise direction, the pusher has a height in a height direction perpendicular to the lengthwise and widthwise directions, and the cross-section of the body in the lengthwise direction between the respective sliding slots of the sides of the body is uniform below the height of the pusher.

In an embodiment consistent with the second taco holder described above, the pusher is inwardly curved to conform to the edges of the sides of the taco shell of the cradled taco.

In an embodiment consistent with the second taco holder described above, each side of the body extends away from the bottom of the body at an oblique angle to define the angled cross-section of the body and wherein the shape of the pusher conforms to the so-defined oblique angles to define the angled cross-section of the body.

In an embodiment consistent with the second taco holder described above, edges of the pusher adjacent to each side of the rigid body move in response to the applied pressure with a uniform, close spacing to each side, whereby the edges of the sides of the taco shell of the contacted taco are engaged by the pusher throughout its movement in the lengthwise direction.

Any combinations of the various embodiments and implementations disclosed herein can be used. These and other aspects and features can be appreciated from the following description of certain embodiments together with the accompanying drawings and claims.

BRIEF DESCRIPTION OF THE DRAWINGS

It is noted that the drawings are illustrative and not necessarily to scale, and that the same or similar features have the same or similar reference numerals throughout.

DETAILED DESCRIPTION OF CERTAIN EMBODIMENTS OF THE DISCLOSURE

Figure 1:
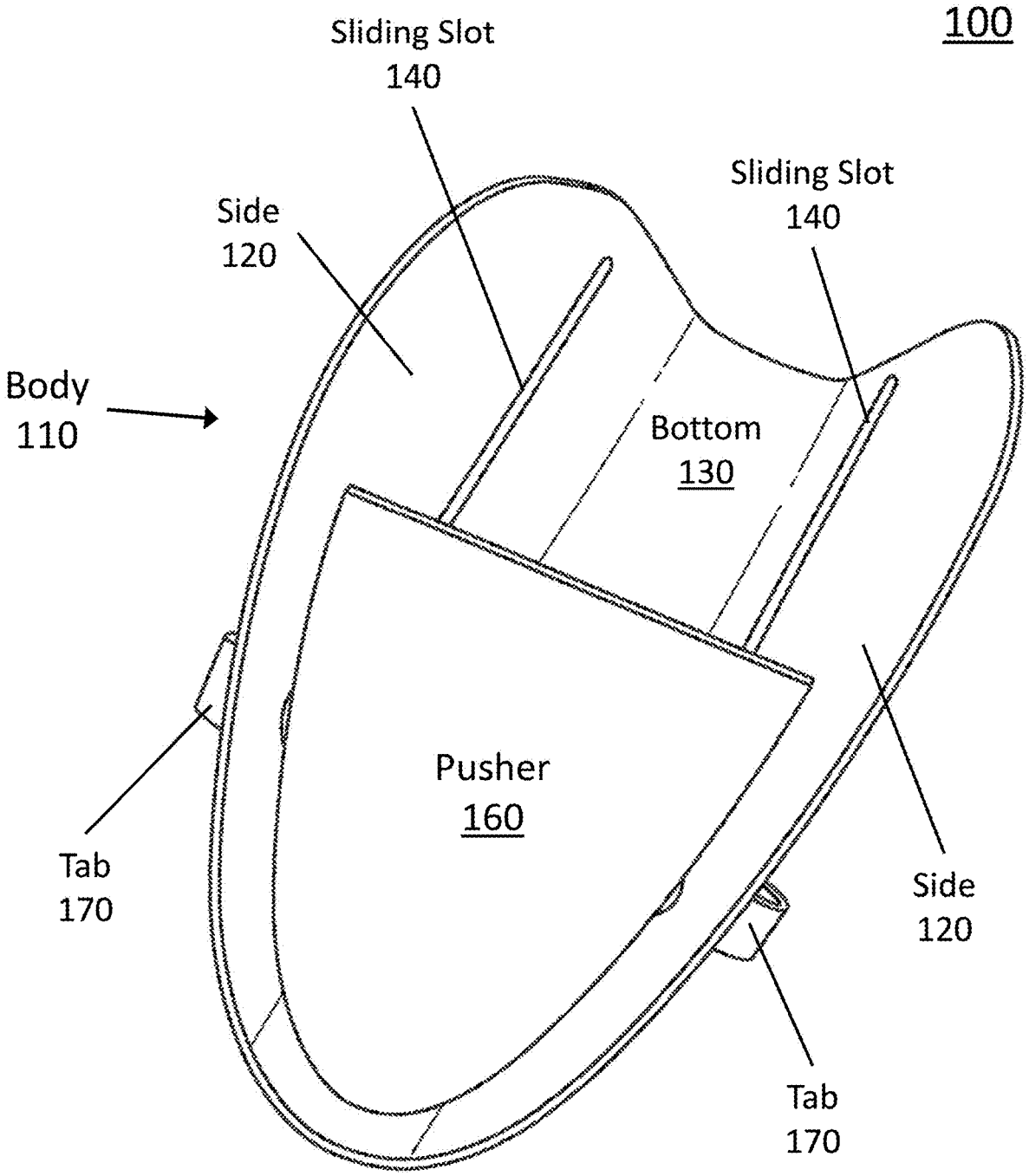
FIG. 1 shows an oblique view of an example taco holder, according to an embodiment.

In example embodiments, a taco holder is provided. The taco holder holds (for example, cradles) a hard-sided taco while containing the filling and protecting the taco shell from early breakage. In addition, the taco holder advances the taco from one end (a back end or rear end) of the taco holder to the other end (a front end or truncated end) to permit eating of the taco with little mess or breakage. In some embodiments, the taco holder has an elevated rest at the front end to facilitate standing the taco holder (and cradled taco) upright on a flat level surface with the front end being higher than the back end. The taco holder includes a movable pusher at the back end that contacts the back end of the taco and moves the taco forward during consumption. In some embodiments, the pusher is tongue-shaped. The pusher helps protect the taco shell from breaking and helps contain the filling (or contents) of the taco within the taco holder. This results in cleaner eating with less breakage of the taco shell.

As mentioned above, while tacos are popular foods, factors such as the type and amount of filling (e.g., meat, lettuce, cheese, tomatoes, to name a few) along with the fragile nature of hard-sided taco shells contribute to challenges in consuming tacos without unintended mess or shell breakage.

Accordingly, in example embodiments of the present disclosure, taco holders that reduce or possibly eliminate such undesired or unintended consequences are provided. Some such taco holders hold a filled taco while preventing messing the hands or the table when eating the taco. In some embodiments, the taco holder includes a taco-shell-shaped body to contain and hold a filled taco (such as a filled taco of similar size to the body). In some embodiments, the body has truncated (such as flat or straight) edges at one end (that is, a truncated end) in order to allow convenient access to the taco while eating. On the two sides of the body are respective sliding slots (such as extending through or penetrating the body). In some embodiments, the bottom of the body also has a sliding slot.

Each sliding slot provided extends in the lengthwise direction of the body. The taco holder further has a pushing tongue-like piece (a pusher) with corresponding tabs extending into (and possibly through) the sliding slots. The tabs hold the pusher in the same orientation in the body, allowing the pusher to fill the cross-section of the body (or at least the lower cross-section of the body) while the sliding slots enable the pusher to move from one end of the body to the other (truncated) end while pushing a taco cradled in the body out of the holder for consumption by the user. By moving the tabs from outside the body (such as tabs that extend from inside the body to outside the body), the pusher (and corresponding cradled taco) move along the sliding slots from one end of the body to the other end (e.g., the truncated end), allowing the taco to be eaten one bite at a time without mess and without breaking the shell. Further details are now described with reference to FIGS. 1-10.

Figure 2:
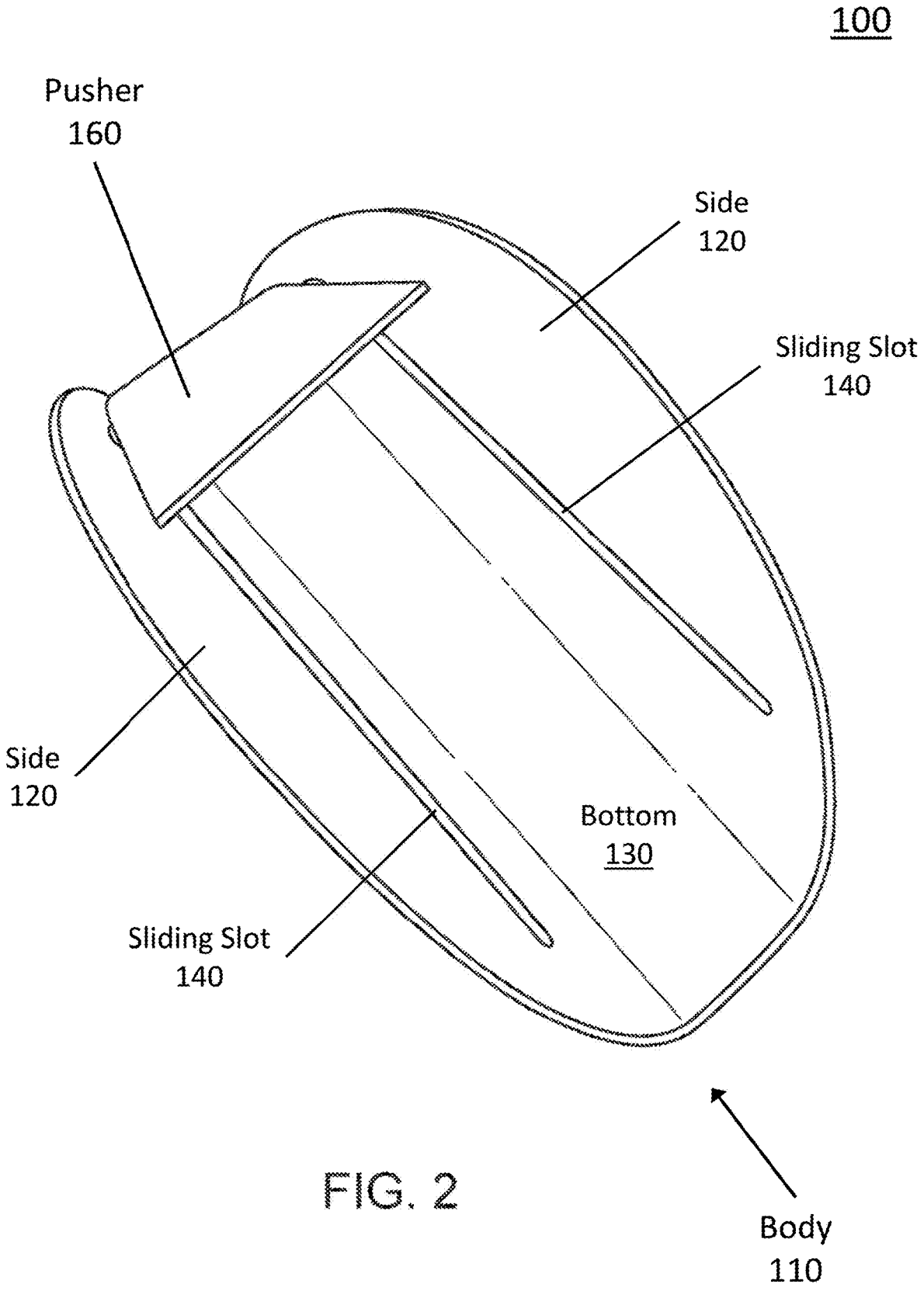
FIG. 2 shows a top view of the taco holder of FIG. 1.
Figure 3:
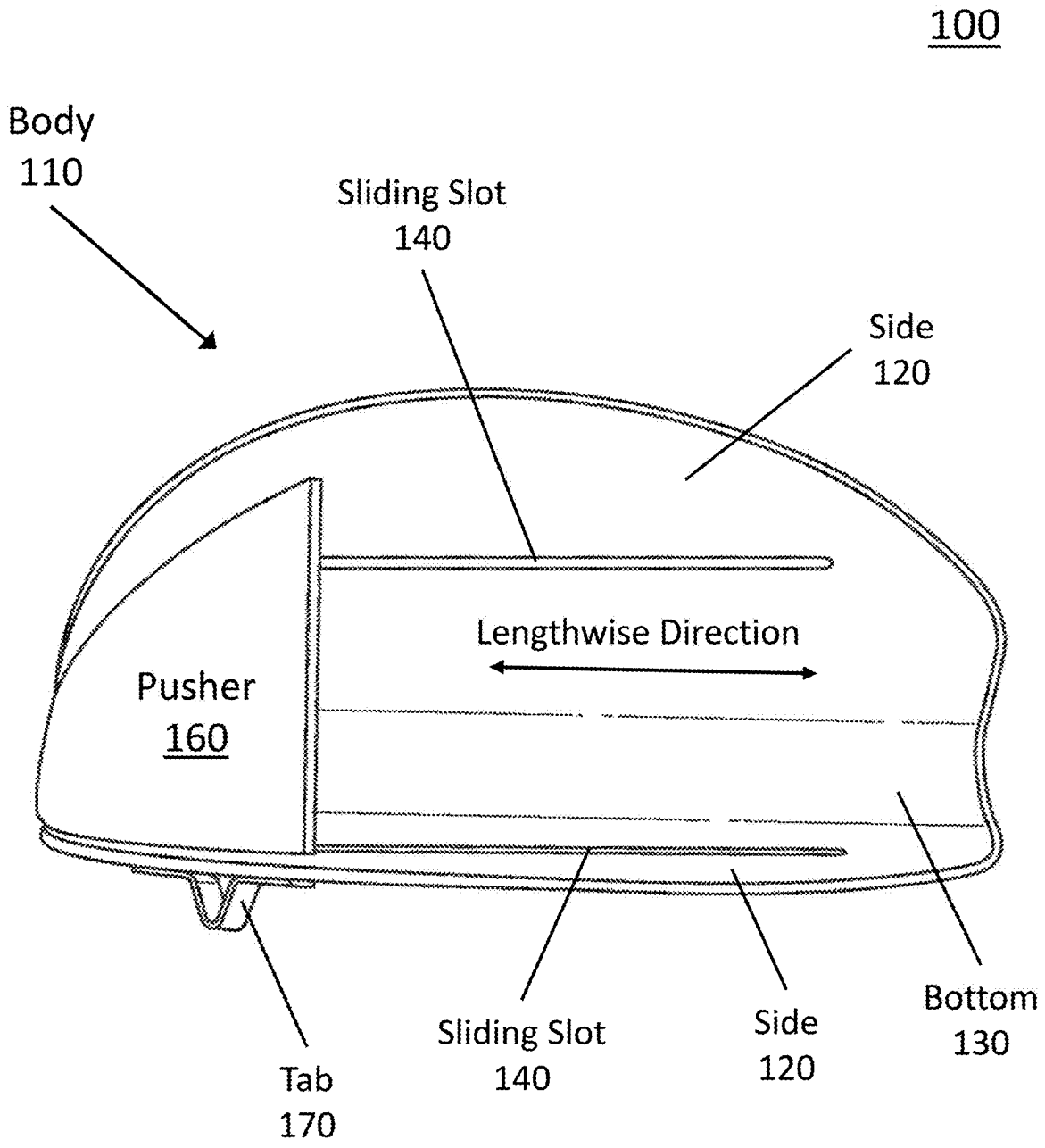
FIG. 3 shows another oblique view of the taco holder of FIGS. 1-2.
Figure 4:
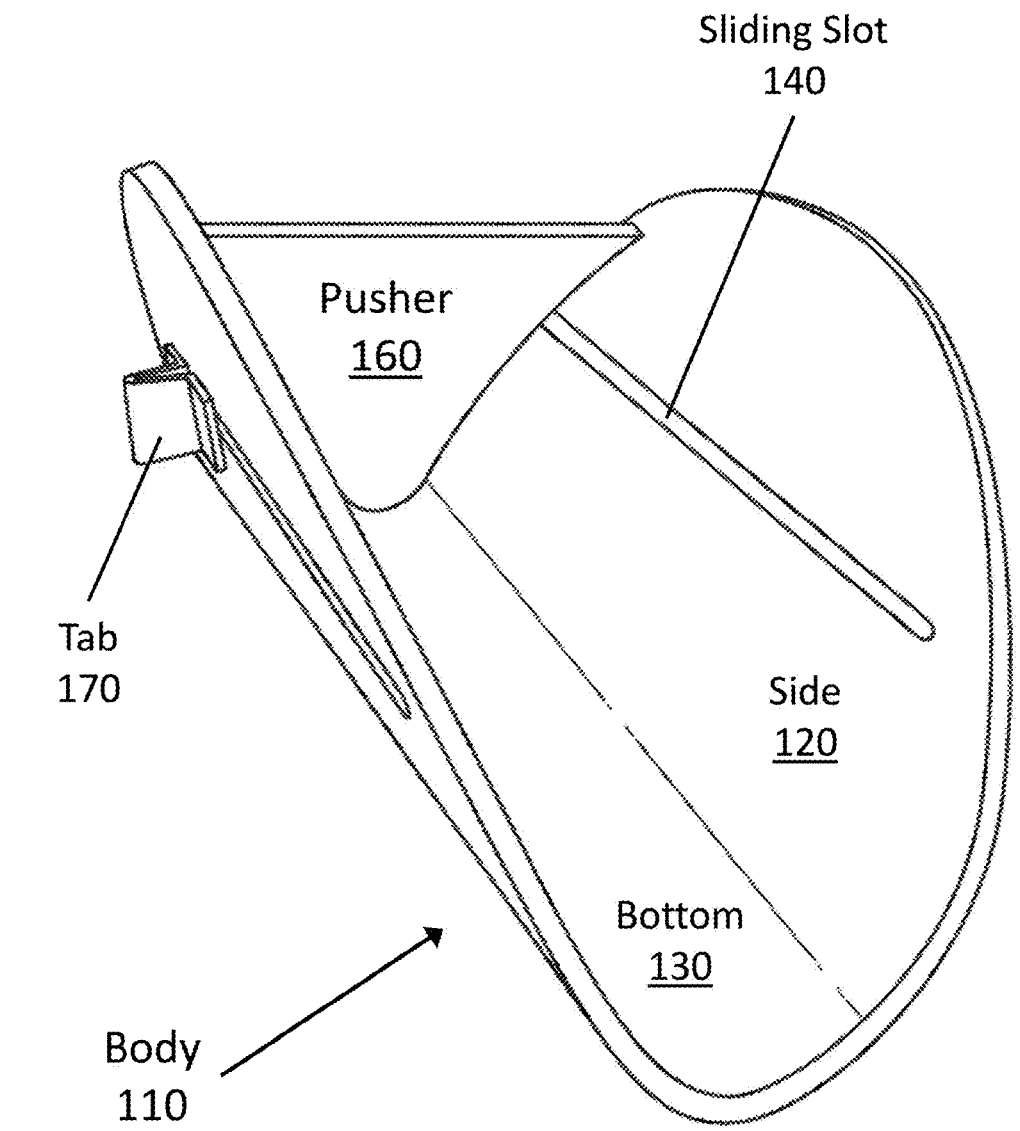
FIG. 4 shows yet another oblique view of the taco holder of FIGS. 1-3.
Figure 5:
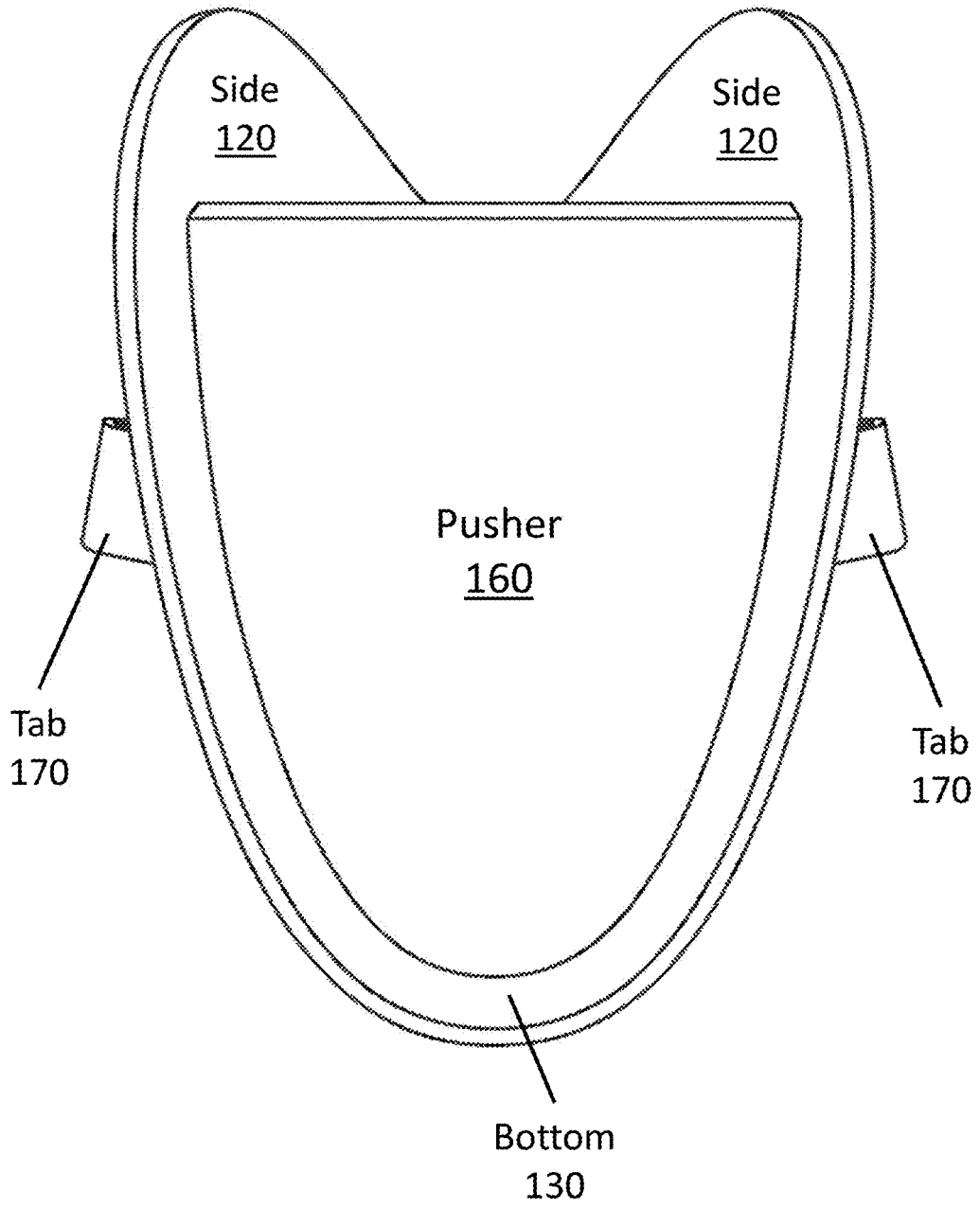
FIG. 5 shows a rear view of the taco holder of FIGS. 1-4.
Figure 6:
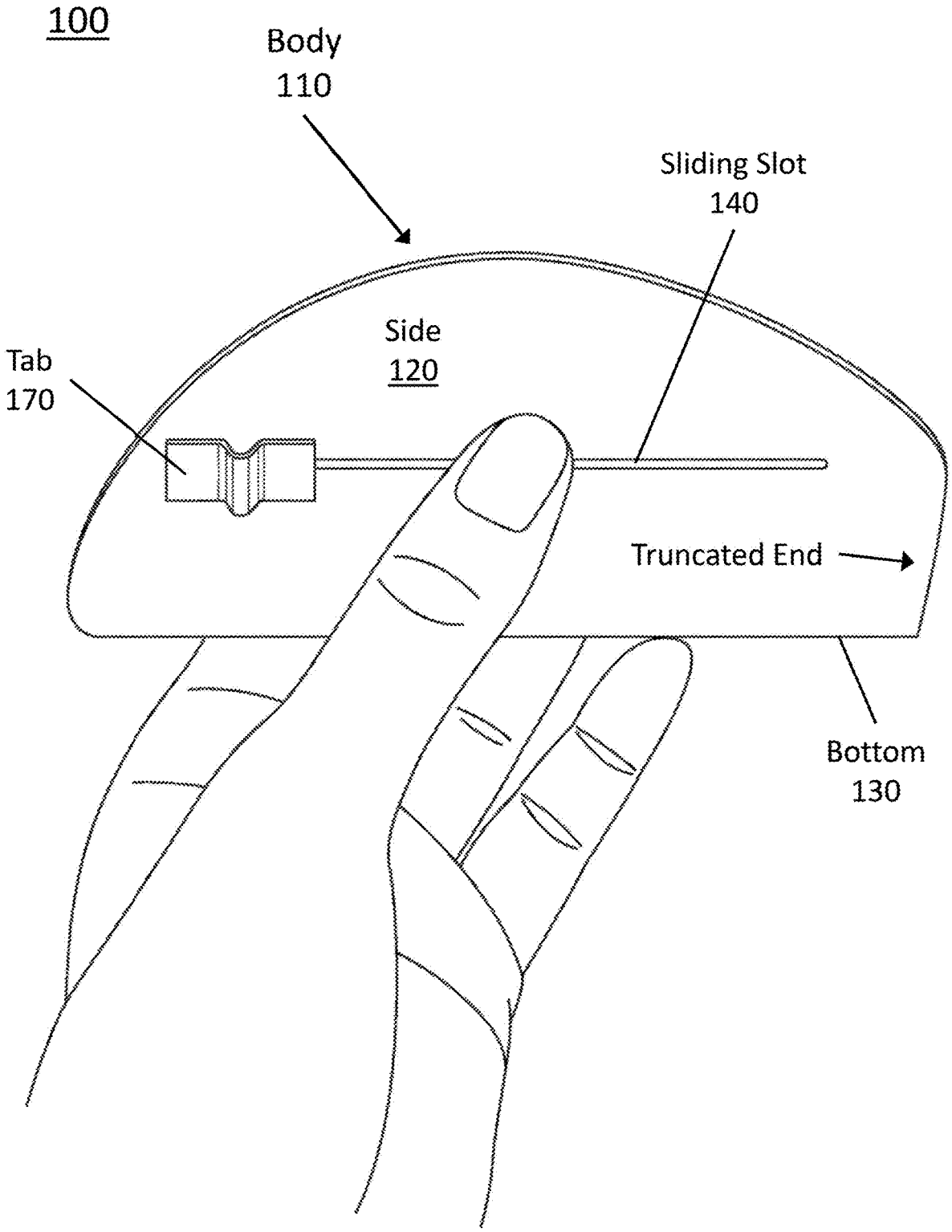
FIG. 6 shows a side view of the taco holder of FIGS. 1-5.

FIG. 1 shows an oblique view of an example taco holder 100, according to an embodiment. FIG. 2 shows a top view of the taco holder 100 of FIG. 1. FIG. 3 shows another oblique view of the taco holder 100 of FIGS. 1-2. FIG. 4 shows yet another oblique view of the taco holder 100 of FIGS. 1-3. FIG. 5 shows a rear view of the taco holder 100 of FIGS. 1-4. FIG. 6 shows a side view of the taco holder 100 of FIGS. 1-5.

Referring to FIGS. 1-6, the taco holder 100 is for holding a hard-sided taco while eating. However, the taco holder 100 is not limited to consuming hard-sided tacos. For example, the taco holder 100 can also be used to eat other partially-wrapped food items, such as soft-sided tacos or lettuce wraps. The taco holder 100 includes a rigid body 110 and a tongue-like pusher 160. The body 110 and pusher 160 can be made of any durable material suitable for contacting tacos and other foods, such as plastic, metal, or wood. The body 110 and the pusher 160 together cradle the hard-sided taco being consumed. This helps confine the filling of the taco to the taco holder 100 while also retarding unintended breakage of the shell. The pusher 160 provides the required force to move the taco from one end of the taco holder 100 to the truncated end at the desired rate of consumption.

The body 110 has a truncated shape of similar proportions to a taco shell of the hard-sided taco being consumed (such as slightly larger, ignoring the truncated end). The body 110 includes two sides 120 and a bottom 130 connecting the two sides 120 and corresponding to sides and bottom of the taco shell. Here, the inside of the body 110 is larger than the taco, and cradles the taco in a lengthwise direction along a length of the taco. The sides 120 of the body 110 include respective sliding slots 140 penetrating the body 110. The sides 120 are arranged in the lengthwise direction. In some embodiments, the sides of the body extend away from the bottom at an oblique angle in order to accommodate a filled taco. The oblique angle defines an angled cross-section of the body (see FIG. 4).

The pusher 160 has a shape of an angled cross-section of the body 110. In some embodiments, the edges of the pusher conform to oblique angles to define the angled cross-section of the body. The pusher 160 contacts respective edges of the sides of the cradled taco. The pusher 160 includes respective tabs 170 extending through the sliding slots 140 for securing the pusher 160 to the inside of the body 110 while allowing movement of the pusher 160 and contacted taco along the inside of the body 110 in the lengthwise direction. The pusher 160 pushes the taco from one end of the body 110 to the truncated end of the body 110 in response to pressure that has been applied to at least one of the tabs 170 from an outside of the body 110 in the lengthwise direction. The tabs 170 transfer the lengthwise force to the pusher 160, which in turn moves the taco lengthwise to the truncated end. In some embodiments, the pusher 160 is angled (from vertical) to better apply force to the edges of the taco, which helps better cradle the taco (resulting in less mess) and prevent unintended breakage of the entire taco shell during eating. In some embodiments, edges of the pusher 160 that are adjacent to each side of the body 110 advance between the sides of the body toward the truncated end with a uniform, close spacing to each side 120, whereby edges of the taco shell are engaged by the pusher throughout its movement in the lengthwise direction.

In some embodiments, the truncated end of the body 110 includes a rest to elevate the truncated end of the body 110 with respect to the one end of the body 110 when resting on a flat level surface (such as a table or tray). The rest contacts the surface in conjunction with the one end of the body 110 (such as by three points of contact) and allows the body 110 (and cradled taco) to stand up on the surface when the taco holder 100 is not being handled by a user. The taco holder 100 can still hold a taco while in this standing position, which allows the user to take a break from eating the taco without having to hold onto the taco. In some such embodiments, the rest makes at least two points of contact with the surface when the body 110 is standing up (while the other end of the taco holder 100 provides at least one point of contact with the table or other surface).

In some embodiments, the bottom 130 of the body 110 is flat. This allows the taco holder 100 to more easily stand up, even without a rest. It also allows better cradling of flat-bottomed taco shells. In some embodiments, the taco shell (and by extension, the body 110 of the taco holder 100) has a shape of a symmetrically folded circle. The fold is centered at the bottom of the taco shell and extends in the lengthwise direction when the taco is cradled in the taco holder 100.

In some embodiments, the sliding slots 140 oppose each other in a widthwise direction perpendicular to the lengthwise direction. In addition, the pusher 160 has a height in a height direction perpendicular to the lengthwise and widthwise directions. Further, the cross-section of the body 110 in the lengthwise direction (between the sliding slots 140) is uniform below the height of the pusher 160. In some embodiments, the pusher 160 is inwardly curved to conform to the edges of the sides of the taco shell. This allows for still better contact with the taco and even further reduced likelihood of unintended shell breakage.

Figure 7:
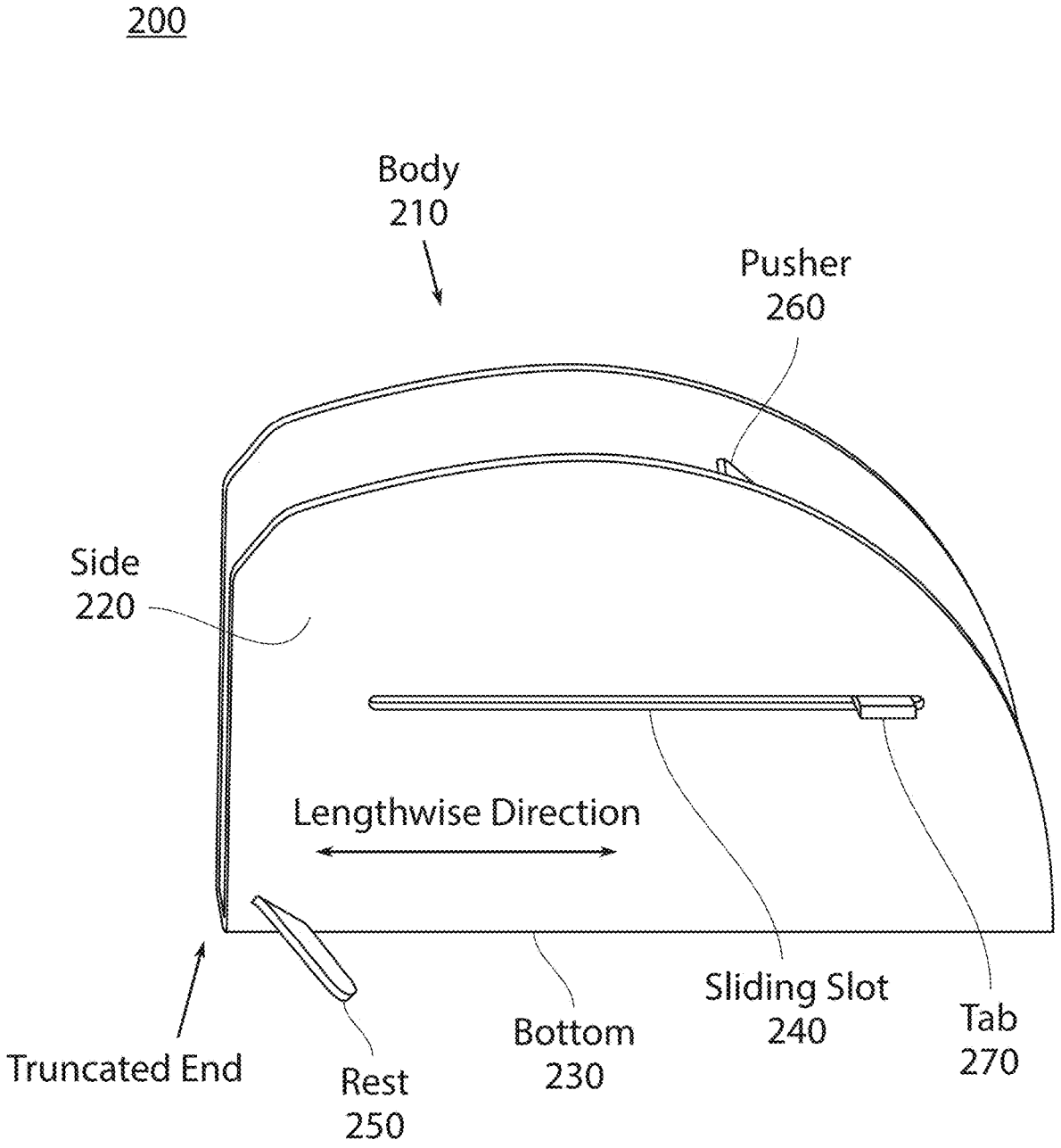
FIG. 7 shows a side view of an example taco holder, according to another embodiment.
Figure 8:
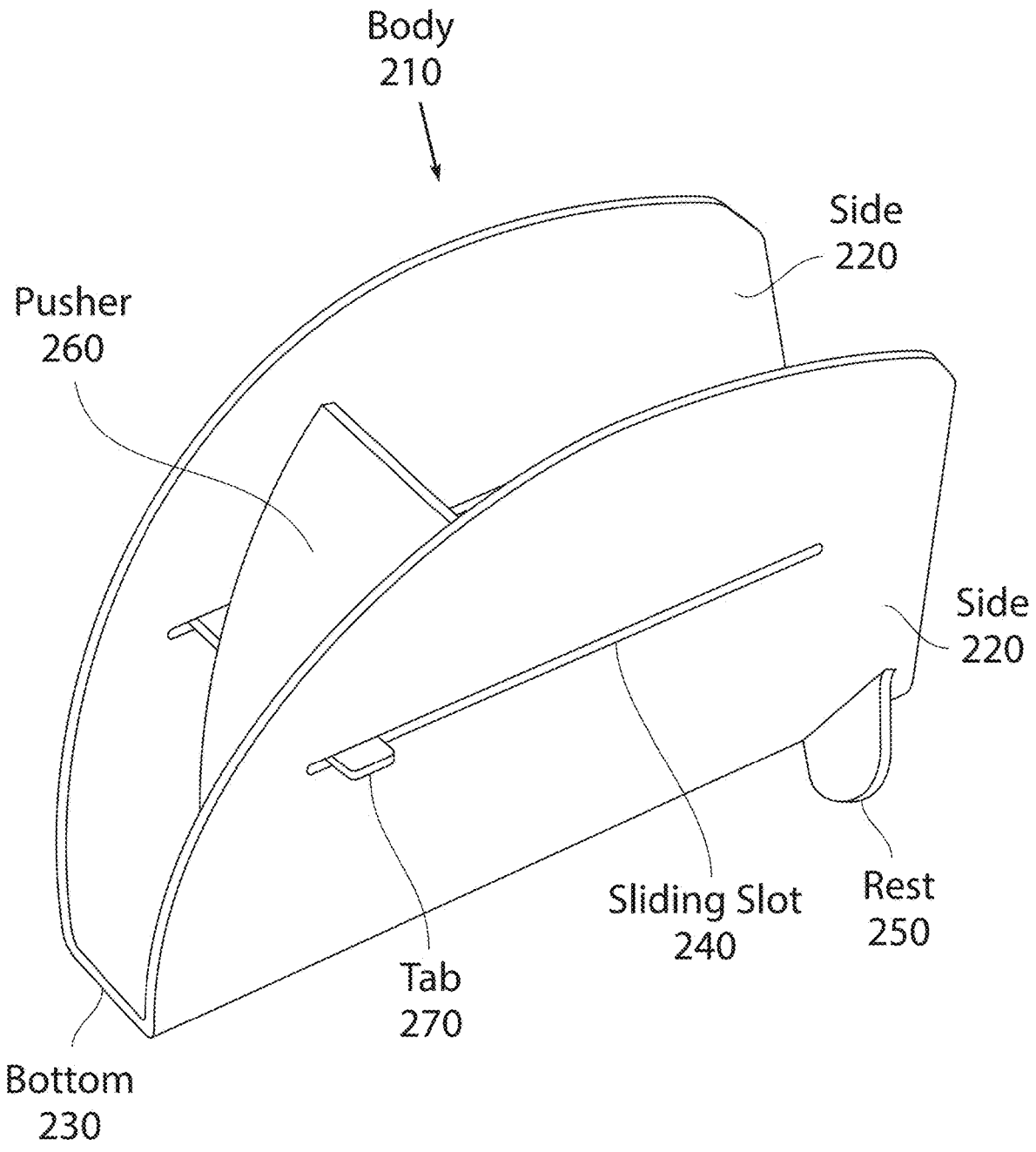
FIG. 8 shows an oblique view of the taco holder of FIG. 7.
Figure 9:
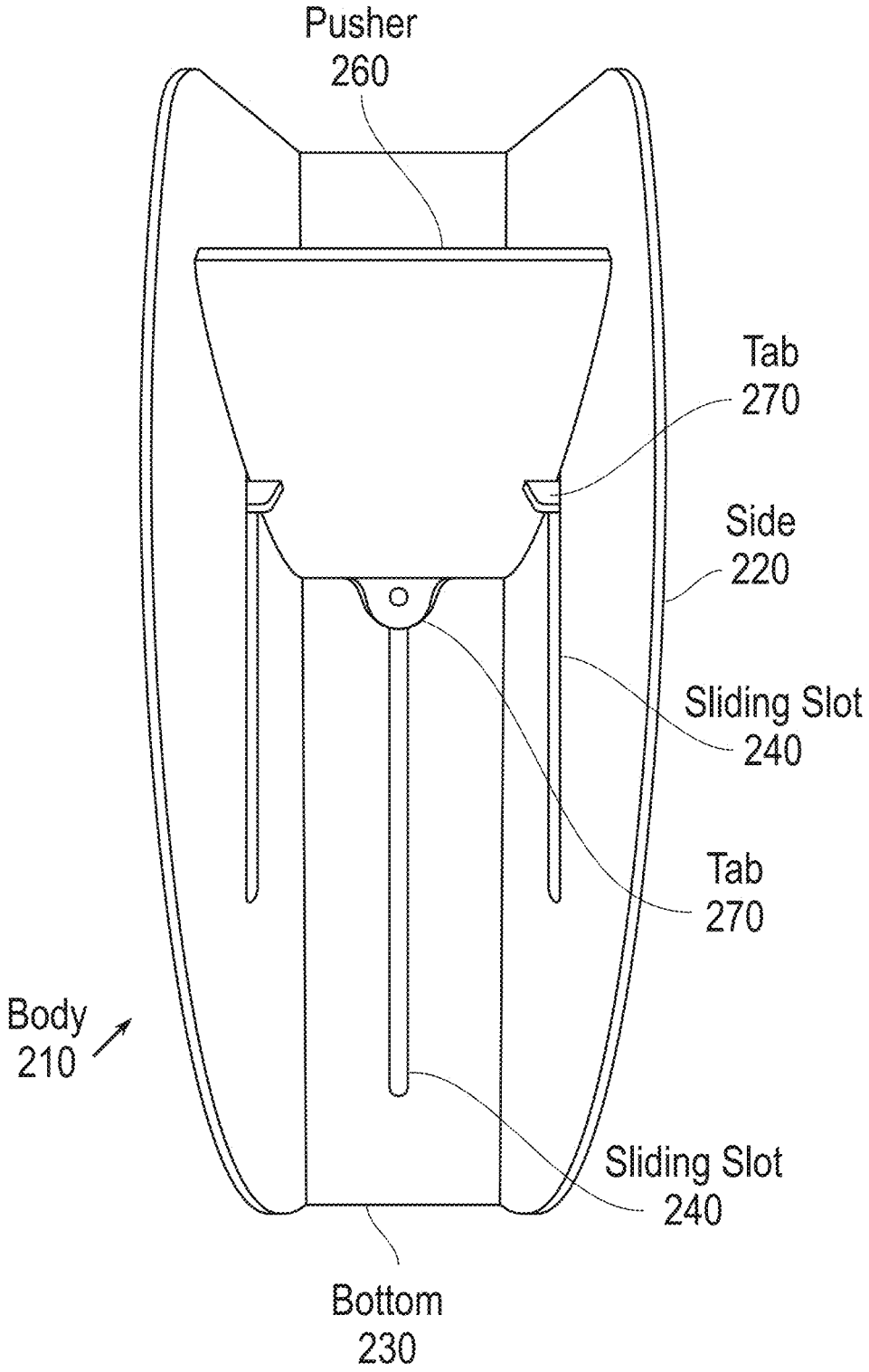
FIG. 9 shows an elevated front view of the taco holder of FIGS. 7-8.
Figure 10:
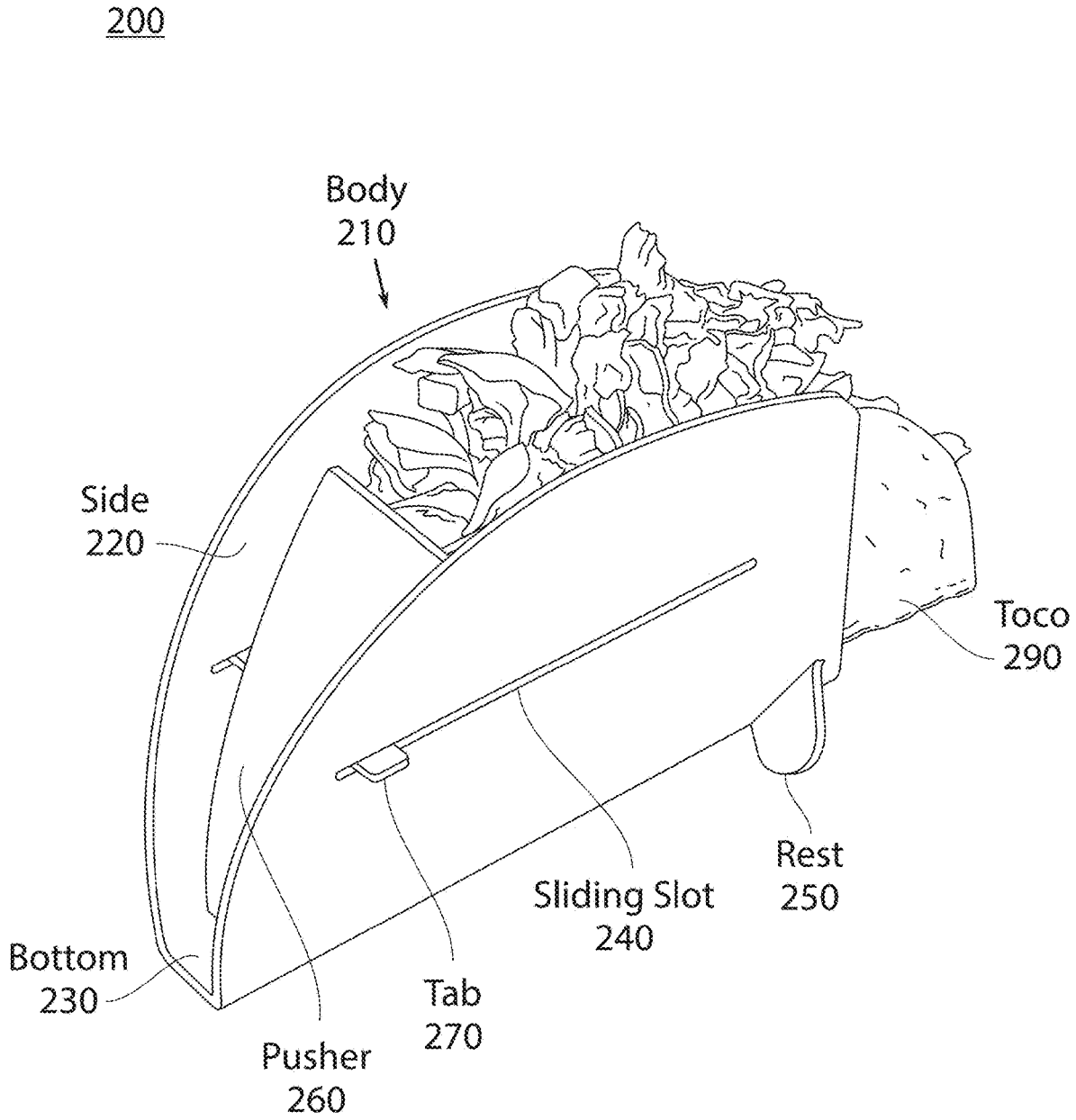
FIG. 10 shows an oblique view of the taco holder of FIGS. 7-9 cradling a hard-shell taco.

FIG. 7 shows a side view of an example taco holder 200, according to another embodiment. FIG. 8 shows an oblique view of the taco holder 200 of FIG. 7. FIG. 9 shows an elevated front view of the taco holder 200 of FIGS. 7-8. FIG. 10 shows an oblique view of the taco holder 200 of FIGS. 7-9 cradling a hard-shell taco 290.

Referring to FIGS. 7-10, the taco holder 200 is for holding a hard-sided taco 290 while eating. The taco holder 200 includes a rigid body 210 and a pusher 260. The body 210 has a truncated shape of similar proportions to a taco shell of the hard-sided taco 290, including two sides 220 and a bottom 230 connecting the two sides 220 and corresponding to sides and bottom of the taco shell. The inside of the body 210 is larger than the taco 290 and cradles the taco 290 in a lengthwise direction along a length of the taco 290. The sides 220 and bottom 230 of the body 210 including respective sliding slots 240 arranged in the lengthwise direction.

The pusher 260 has a shape of an angled cross-section of the body 210, optionally the same as described in connection with the first embodiment. The pusher 260 contacts respective edges of the sides of the cradled taco 290. The pusher 260 includes respective tabs 270 extending through the sliding slots 240 for securing the pusher 260 to the inside of the body 210 while allowing movement of the pusher 260 and contacted taco 290 along the inside of the body 210 in the lengthwise direction. The pusher 260 pushes the taco 290 from one end of the body 210 to a truncated end of the body 210 by applying pressure to at least one of the tabs 270 from an outside of the body 210 in the lengthwise direction, In some embodiments, the truncated end of the body 210 includes a rest 250 to elevate the truncated end of the body 210 with respect to the one end of the body 210 when resting on a flat level surface. The rest 250 contacts the surface in conjunction with the one end of the body and allows the body 210 (and cradled taco 290, see FIG. 10) to stand up on the surface while not allowing the respective tab 240 (bottom tab) extending through the respective sliding slot 240 of the bottom 230 of the body 210 to contact the surface.

In some embodiments, the rest 250 makes at least two points of contact with the surface when the body 210 is standing up on the surface. In some embodiments, the bottom 230 of the body 210 is flat. In some embodiments, the taco shell has a shape of a symmetrically folded circle. The fold is centered at the bottom of the taco shell and extends in the lengthwise direction when the taco 290 is cradled in the taco holder 200.

In some embodiments, the respective sliding slots 240 of the sides 220 of the body 210 oppose each other in a widthwise direction perpendicular to the lengthwise direction. The pusher 260 has a height in a height direction perpendicular to the lengthwise and widthwise directions. The cross-section of the body 210 in the lengthwise direction between the respective sliding slots 240 of the sides 220 of the body 210 is uniform at least below the height of the pusher 260. In some embodiments, the pusher 260 is inwardly curved to conform to the edges of the sides of the taco shell.

In summary, in example embodiments, a taco holder is constructed to contain and hold a filled taco for convenience and cleanness in eating. The taco holder includes a taco shell shaped body to contain and hold a filled taco. The shell has a flat (or truncated) edge at one end in order to allow a taco eater to eat the taco conveniently. On the two sides of the shell body are constructed two sliding slots. In each of the slots is disposed with a sliding bar that is connected with a tongue-like piece. When the shell body holds a filled taco inside, by moving the sliding bar, the tongue-like piece pushes the filled taco out of the taco holder for the taco eater to eat one bite at a time.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A taco holder for holding a hard-sided taco while eating, the taco holder comprising:

a rigid body having a truncated shape of similar proportions to a taco shell of the hard-sided taco, including two sides and a bottom connecting the two sides and corresponding to sides and bottom of the taco shell, an inside of the body being larger than and configured to cradle the hard-sided taco in a lengthwise direction along a length of the taco, the sides of the body including respective sliding slots penetrating the body and arranged in the lengthwise direction; and a pusher having a shape of an angled cross-section of the body and configured to contact respective edges of the sides of the taco shell of the cradled taco, the pusher comprising respective tabs extending through the sliding slots for securing the pusher to the inside of the body while allowing movement of the pusher and contacted taco along the inside of the body in the lengthwise direction, wherein the pusher is configured to push the contacted taco from one end of the body to a truncated end of the body in response to pressure applied to at least one of the tabs from an outside of the body in the lengthwise direction.

2. The taco holder of claim 1, wherein the truncated end of the body comprises a rest to elevate the truncated end of the body with respect to the one end of the body when resting on a flat level surface, the rest being further configured to contact the surface in conjunction with the one end of the body and allow the body and cradled taco to stand up on the surface.

3. The taco holder of claim 2, wherein the rest is further configured to make at least two points of contact with the surface when the body is standing up.

4. The taco holder of claim 1, wherein the bottom of the body is flat.

5. The taco holder of claim 1, wherein the taco shell has a shape of a symmetrically folded circle, the fold being centered at the bottom of the taco shell and extending in the lengthwise direction when the hard-sided taco is cradled in the taco holder.

6. The taco holder of claim 1, wherein the sliding slots oppose each other in a widthwise direction perpendicular to the lengthwise direction, the pusher has a height in a height direction perpendicular to the lengthwise and widthwise directions, and the cross-section of the body in the lengthwise direction between the sliding slots is uniform below the height of the pusher.

7. The taco holder of claim 1, wherein the pusher is inwardly curved to conform to the edges of the sides of the taco shell of the cradled taco.

8. The taco holder of claim 1, wherein each side of the body extends away from the bottom of the body at an oblique angle to define the angled cross-section of the body and wherein the shape of the pusher conforms to the so-defined oblique angles to define the angled cross-section of the body.

9. The taco holder of claim 1, wherein edges of the pusher adjacent to each side of the rigid body move in response to the applied pressure with a uniform, close spacing to each side, whereby the edges of the sides of the taco shell of the contacted taco are engaged by the pusher throughout its movement in the lengthwise direction.

10. A taco holder for holding a hard-sided taco while eating, the taco holder comprising:

a rigid body having a truncated shape of similar proportions to a taco shell of the hard-sided taco, including two sides and a bottom connecting the two sides and corresponding to sides and bottom of the taco shell, an inside of the body being larger than and configured to cradle the hard-sided taco in a lengthwise direction along a length of the taco, the sides and bottom of the body including respective sliding slots arranged in the lengthwise direction; and a pusher having a shape of an angled cross-section of the body and configured to contact respective edges of the sides of the taco shell of the cradled taco, the pusher comprising respective tabs extending through the sliding slots for securing the pusher to the inside of the body while allowing movement of the pusher and contacted taco along the inside of the body in the lengthwise direction, wherein the pusher is configured to push the contacted taco from one end of the body to a truncated end of the body in response to pressure applied to at least one of the tabs from an outside of the body in the lengthwise direction.

11. The taco holder of claim 10, wherein the truncated end of the body comprises a rest to elevate the truncated end of the body with respect to the one end of the body when resting on a flat level surface, the rest being further configured to contact the surface in conjunction with the one end of the body and allow the body and cradled taco to stand up on the surface while not allowing the respective tab extending through the respective sliding slot of the bottom of the body to contact the surface.

12. The taco holder of claim 11, wherein the rest is further configured to make at least two points of contact with the surface when the body is standing up on the surface.

13. The taco holder of claim 10, wherein the bottom of the body is flat.

14. The taco holder of claim 10, wherein the taco shell has a shape of a symmetrically folded circle, the fold being centered at the bottom of the taco shell and extending in the lengthwise direction when the hard-sided taco is cradled in the taco holder.

15. The taco holder of claim 10, wherein the respective sliding slots of the sides of the body oppose each other in a widthwise direction perpendicular to the lengthwise direction, the pusher has a height in a height direction perpendicular to the lengthwise and widthwise directions, and the cross-section of the body in the lengthwise direction between the respective sliding slots of the sides of the body is uniform below the height of the pusher.

16. The taco holder of claim 10, wherein the pusher is inwardly curved to conform to the edges of the sides of the taco shell of the cradled taco.

17. The taco holder of claim 10, wherein each side of the body extends away from the bottom of the body at an oblique angle to define the angled cross-section of the body and wherein the shape of the pusher conforms to the so-defined oblique angles to define the angled cross-section of the body.

18. The taco holder of claim 10, wherein edges of the pusher adjacent to each side of the rigid body move in response to the applied pressure with a uniform, close spacing to each side, whereby the edges of the sides of the taco shell of the contacted taco are engaged by the pusher throughout its movement in the lengthwise direction.

* * * * *